US007264518B2

(12) United States Patent
Ellis

(10) Patent No.: US 7,264,518 B2
(45) Date of Patent: Sep. 4, 2007

(54) ELECTRICAL CONTACT INCLUDING INTEGRAL STOP MEMBER

(75) Inventor: John W. Ellis, Advance, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/299,400

(22) Filed: Dec. 12, 2005

(65) Prior Publication Data

US 2007/0134996 A1 Jun. 14, 2007

(51) Int. Cl.
*H01R 11/22* (2006.01)

(52) U.S. Cl. ..... 439/852; 439/595; 439/948

(58) Field of Classification Search ..... 439/851, 439/852, 595, 948
See application file for complete search history.

(56) References Cited

U.S. PATENT DOCUMENTS 4,560,231 A * 12/1985 Shirai ..... 439/843
4,838,816 A * 6/1989 Matsusaka et al. ..... 439/861
5,443,592 A * 8/1995 Ittah et al. ..... 439/851
5,601,458 A * 2/1997 Ohsumi et al. ..... 439/852
5,624,273 A * 4/1997 Myer ..... 439/399
5,630,738 A * 5/1997 Ito et al. ..... 439/852
5,643,018 A * 7/1997 Sakai et al. ..... 439/852
5,660,569 A * 8/1997 Yamada et al. ..... 439/862
5,736,678 A * 4/1998 Kobayashi ..... 174/84 C
5,772,454 A * 6/1998 Long, Jr. ..... 439/83
5,788,542 A * 8/1998 Miwa ..... 439/851
5,893,781 A * 4/1999 Matsunaga et al. ..... 439/762
5,941,741 A * 8/1999 Dobbelaere et al. ..... 439/852
6,024,612 A * 2/2000 Myer et al. ..... 439/852
6,244,910 B1 * 6/2001 Grubbs ..... 439/852
6,527,601 B2 * 3/2003 Chen ..... 439/852
6,544,080 B1 * 4/2003 Yamamoto ..... 439/849
6,629,865 B2 * 10/2003 Bungo ..... 439/852

OTHER PUBLICATIONS

Molex; 3.96mm (.156") Pitch Wire-to-Board Terminal—No. 50539.
Molex; 3.96mm (.156") Pitch Wire-to-Board Receptacle—No. 51144 Positive Lock.

* cited by examiner

*Primary Examiner*—Neil Abrams
*Assistant Examiner*—Harshad C Patel

(57) ABSTRACT

An electrical contact is provided. An embodiment of the electrical contact includes a bottom member, a pair of side walls and a tongue. The bottom member includes a first portion and a second potion and also defines a horizontal plane. The pair of sides walls extend away from the bottom member. The pair of side walls define an opening therebetween which is located above the second portion of the bottom member. The tongue extends at an angle with respect to the horizontal plane. A wire is insertable into the electrical contact from the first portion of the bottom member and a post or conductor is insertable into the opening. At least a portion of the tongue helps maintain at least a portion of the post at least partially within the electrical contact. The electrical contact may also include a fold and a stop member.

19 Claims, 6 Drawing Sheets

ELECTRICAL CONTACT INCLUDING INTEGRAL STOP MEMBER

BACKGROUND

The present disclosure relates to the field of electrical contacts and more particularly to electrical contacts that provide an electrical connection between two electrical components.

Contacts are generally used to provide detachable electrical connections between components of a system. For example, connectors may be used to help transmit electrical power in a system. As connectors are mated, the mating parts exert normal forces on each other. Stronger normal forces result in less contact resistance at the connection. Stated another way, as the normal forces exerted by two connectors on one another increase, the resistance between the connectors decreases, and visa versa. As the resistance is decreased, the current capacity of the connectors increases. Contacts may also be gold-plated to reduce contact resistance. Lower contact resistance is generally desirable, since, as current passes through the contact, the contact will heat up more as the contact resistance level increases. The contact resistance, and resulting heating of the contact, determine the maximum amount of current that the connector is capable of carrying. However, higher normal forces, while reducing contact resistance, generally have the detrimental effect of increasing wear as the connector is mated and unmated, thereby limiting the durability of the connector. Prior art contacts have had to sacrifice one of the important qualities of lower contact resistance or durability to achieve the other.

In the field of electrical contacts, an electrical contact may be inserted into a contact housing. The electrical contact may be held in place by a lance disposed on the electrical contact or by a finger disposed on the contact housing. The strength of the lance or finger may help to determine how much of a back-out force the contact housing may be able to withstand.

The process of connecting a plurality of wires to an electrical contact may be accomplished by inserting the wires into the electrical contact, aligning the wires and crimping the wires in place. During this process, the wires may enter areas of the electrical contact where they are not intended to enter, such as where a post enters the electrical contact. Additionally, it may be difficult to precisely align all of the wires with each other.

It may be useful to provide an electrical contact which provides a greater normal force on a portion of a connector that is inserted therein. It may also be useful to provide an electrical contact including a fold which is capable of withstanding a relatively large back-out force (relative to an electrical contact without a fold). Further, it may be useful to provide an electrical contact which facilitates proper insertion and alignment of a plurality of wires therein.

SUMMARY

An electrical contact is provided. An embodiment of the electrical contact includes a bottom member, a pair of side walls and a tongue. The bottom member includes a first portion and a second potion and also defines a horizontal plane. The pair of sides walls extends away from the bottom member. The pair of side walls also defines an opening therebetween which is located above the second portion of the bottom member. The tongue is located at least partially between the side walls and includes an upper portion and a lower portion. The tongue extends at an angle with respect to the horizontal plane. A wire is insertable into the electrical contact from the first portion of the bottom member and a post is insertable into the opening. At least a portion of the tongue helps maintain at least a portion of the post at least partially within the electrical contact.

In an exemplary embodiment, the bottom member includes an aperture. The aperture is engagable with a finger of a contact housing.

It is envisioned for the tongue to be deflectable. In an embodiment of the disclosure, the lower portion of the tongue is affixed to the bottom member. The tongue may create an angle with the bottom member which is between about 35° and about 55°. At least a portion of the tongue may be biased towards the opening of the electrical contact. More specifically, when a post is inserted into the opening of the electrical contact, the post contacts the tongue and causes the tongue to deflect away from the opening (generally towards the bottom member).

It is contemplated for the electrical contact to include a fold extending away from the bottom member. The fold may be located on a portion of the bottom member that is between the aperture and the second portion.

The present disclosure may also include a stop member extending away from the bottom member. It is contemplated for the stop member to include a horizontal extension extending towards the first portion of the electrical contact.

In an exemplary embodiment, the electrical contact includes a plurality of legs extending away from the bottom member and which come into contact with an inner wall of a contact housing. At least one of these legs may be deflectable, which helps secure the electrical contact within the contact housing.

In an embodiment of the disclosure, the electrical contact includes a top member. The top member extends from at least one side wall and is substantially parallel to the bottom member.

It is also envisioned for the electrical contact to include a plurality of interface points. The interface points extend inwardly from at least one side wall and help maintain at least a portion of the post at least partially within the electrical contact. More specifically, when a post is inserted into the opening of the electrical contact, both the tongue and the interface points may help the post maintain contact with the electrical contact.

DETAILED DESCRIPTION OF THE DRAWINGS

DETAILED DESCRIPTION OF THE EMBODIMENTS

Figure 1:
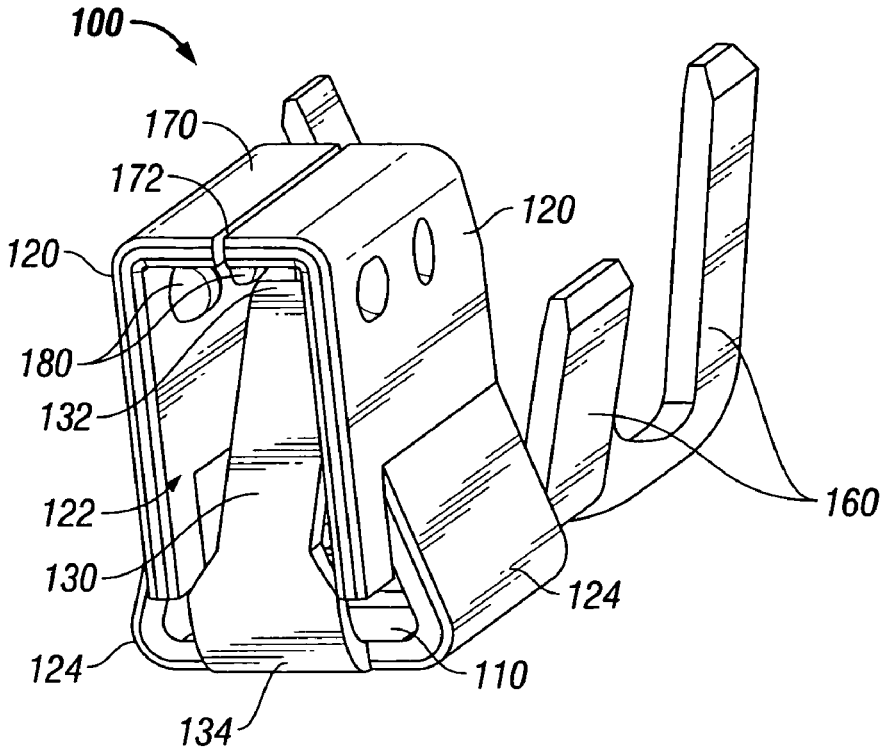
FIG. 1 is a perspective view of an electrical contact according to an embodiment of the present disclosure.

Embodiments of the presently disclosed electrical contact will now be described in detail with reference to the drawing figures wherein like reference numerals identify similar or identical elements.

An electrical contact in accordance with the present disclosure is referenced in the figures by reference numeral 100. A perspective view of the electrical contact 100 is shown in FIG. 1. As will be described with reference to FIGS. 1-8, the electrical contact 100 may be inserted into and secured within a contact housing 200. A wire 300 may be secured to the electrical contact 100 and a post or conductor 400 may be releasably inserted into the electrical contact 100. More specifically and as will be described in more detail below, the wire 300 is secured to the electrical contact 100 near a first portion 112 of a bottom member 110 of the electrical contact 100. Additionally, the post 400 is inserted into the electrical contact 100 through an opening 122 above a second portion 114 of the bottom member 110.

Figure 2:
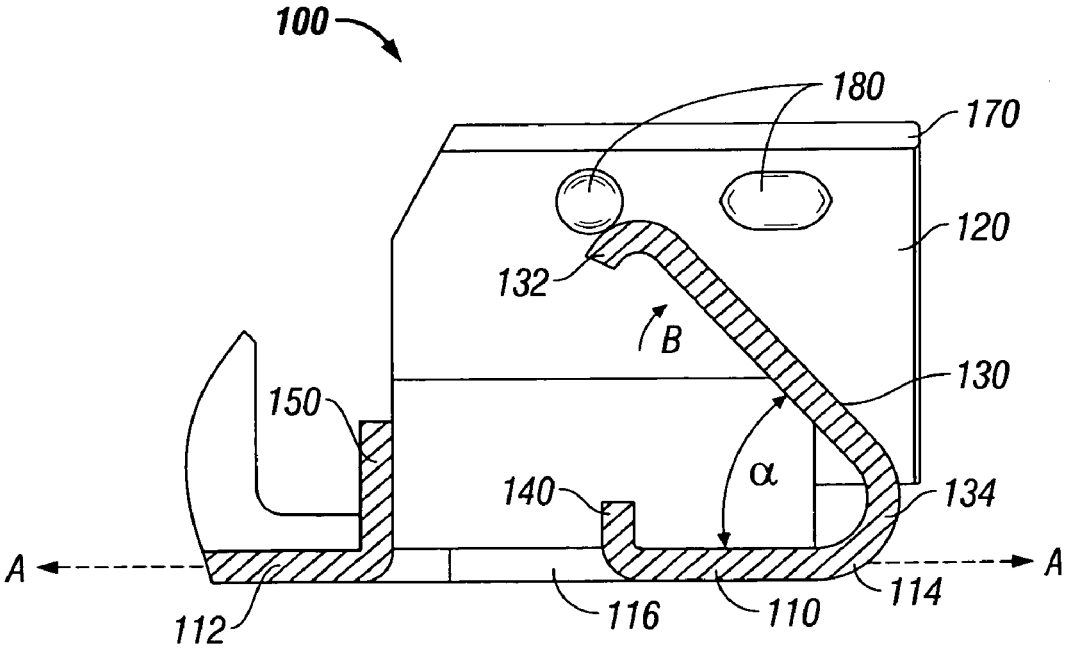
FIG. 2 is a cross-sectional view of an embodiment of the electrical contact of FIG. 1.
Figure 3:
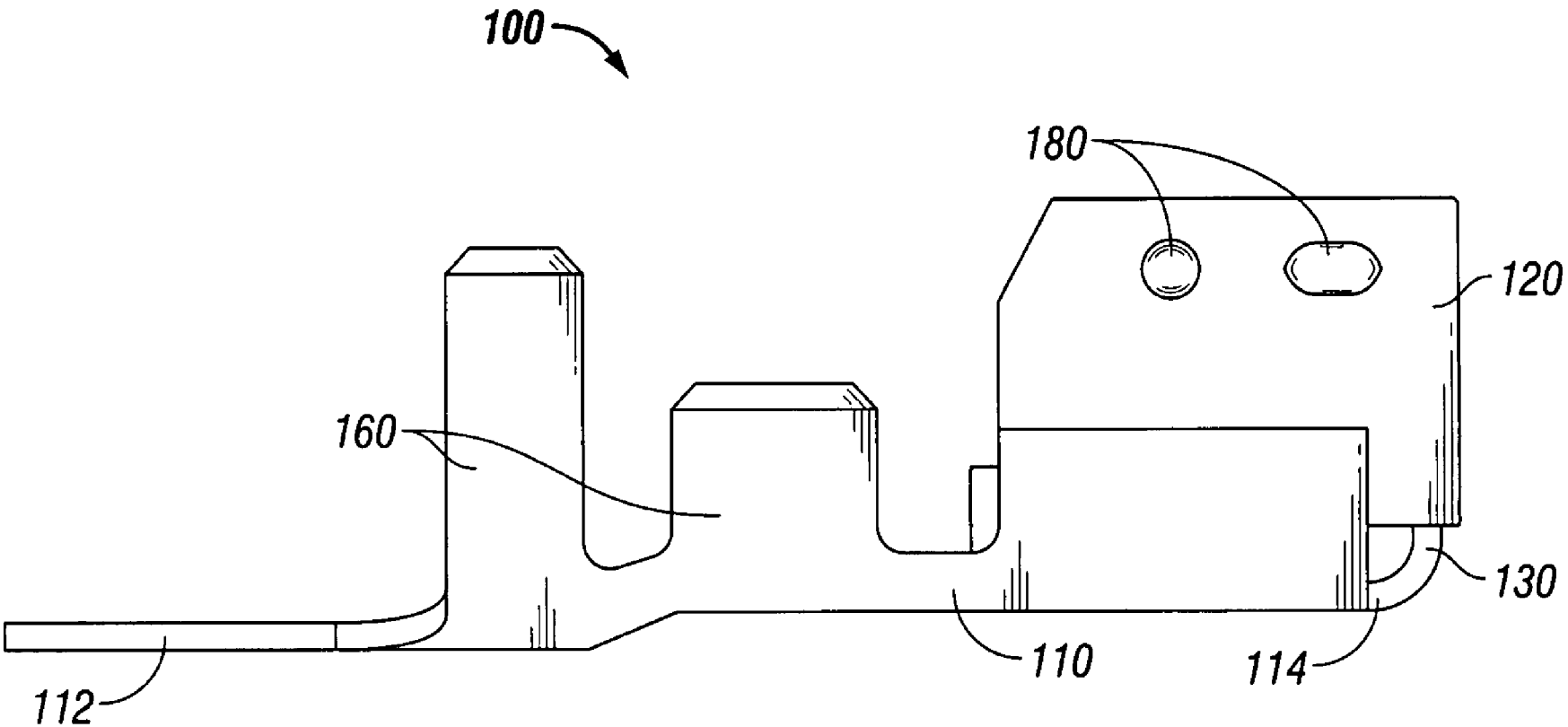
FIG. 3 is a side view of an embodiment of the electrical contact of FIG. 1.
Figure 8:
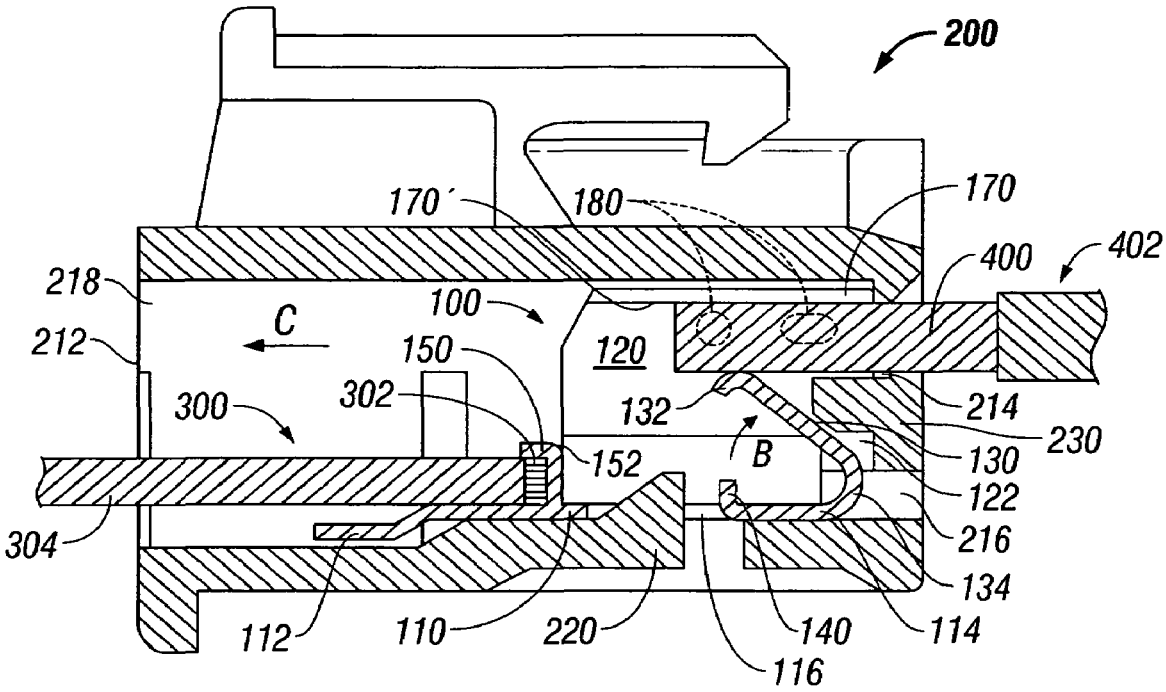
FIG. 8 is a cross-sectional view of an embodiment of the electrical contact of FIG. 1 within the contact housing of FIG. 5 illustrating a wire and a post inserted into the electrical contact.

With reference to FIGS. 1-8, features of various embodiments of the electrical contact 100 will now be described. In an exemplary embodiment, the electrical contact 100 comprises a bottom member 110, side walls 120, which extend substantially vertically from the bottom member 110, and any combination of a tongue 130 (FIGS. 1-5 and 8), a fold 140 (FIGS. 2, 5 and 8) and a stop member 150 (FIGS. 2 and 8). The tongue 130 helps maintain at least a portion of the post 400 within the electrical contact 100 (FIG. 8); the fold 140 helps to ensure that a finger 220 of the contact housing 200 does not become damaged upon rearward movement (in the general direction of arrow C in FIG. 8) of the electrical contact 100; and the stop member 150 facilitates the alignment of the wire 300 and may also help prevent the wire 300 from entering other portions of the electrical contact 100, such as near the opening 122 (FIG. 8).

Figure 5:
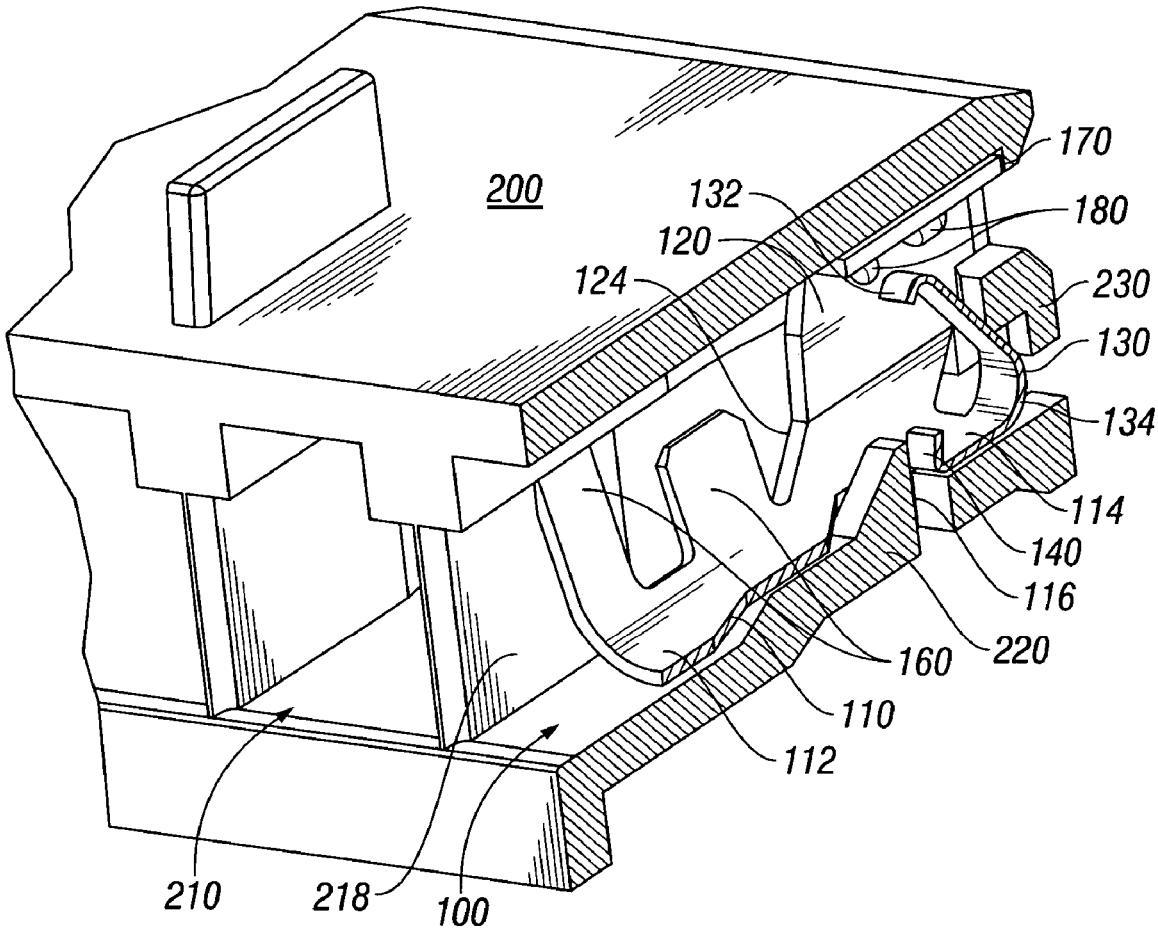
FIG. 5 is a perspective cross-sectional view of an embodiment of the electrical connector of FIG. 1 shown within a contact housing.

With reference to FIGS. 2, 3, 5 and 8, the bottom member 110 defines a horizontal plane A-A (FIG. 2) and includes a first portion 112 and a second portion 114. In an exemplary embodiment, and as best illustrated in FIGS. 2, 5 and 8, an aperture 116 is disposed in the bottom member 110. The function of the aperture 116 can be seen with reference to FIGS. 5 and 8. The aperture generally functions to accept the finger 220 of the contact housing 200. As seen in FIGS. 5 and 8, as the electrical contact 100 is inserted into the contact housing 200, the aperture 116 of the bottom member 110 allows at least a portion of the finger 220 of the contact housing 200 to pass there through. The interaction between the aperture 116 and the finger 220 helps maintain the electrical contact 100 within the contact housing 200.

With reference to FIGS. 1-5 and 8, the side walls 120, which generally extend substantially perpendicularly from the horizontal axis A-A, are shown. An opening 122 (FIG. 1) is disposed between the side walls 120. The opening 122 allows the post 400 (FIG. 8) to enter the electrical contact 100 and to make a connection therewith. In an exemplary embodiment, and as best shown in FIGS. 1 and 5, each of the side walls 120 includes a rib 124, totaling two ribs 124. The ribs 124 may be shaped to increase the contact surface between the electrical contact 100 and inner walls 218 (FIGS. 5 and 8) of the contact housing 200. Thus, the ribs 124 may help provide a better physical connection between the electrical contact 100 and the contact housing 200.

The tongue 130 is illustrated in FIGS. 1-5 and 8. The tongue 130 includes an upper portion 132 and a lower portion 134. In an exemplary embodiment, the lower portion 134 extends at an angle a (see FIG. 2) from the bottom member 110. It is envisioned for this angle a to be in the range from about 35° to about 55° It is contemplated for the tongue 130 to be affixed to the bottom member 110 near the second portion 114 of the bottom member 110. Further, the tongue 130 may be biased in the direction indicated by arrow B in FIGS. 2 and 8, or generally towards the opening 122. The tongue 130 provides a contact surface for the post 400, when the post 400 is inserted into the electrical contact 100. As shown by FIG. 8, the post 400 deflects the tongue 130 (in the direction opposite arrow B in FIG. 8). In response to this deflection, the tongue 130 exerts an upward force on the post 400 (in the direction of arrow B in FIG. 8), which helps maintain the post 400 within the electrical contact 100. The tongue 130 holds the post 400 against an inner surface 170' (FIG. 8) of the electrical contact 100. The insertion of the post 400 into the electrical contact 100 will be described in more detail below.

The fold 140 is shown in FIGS. 2, 5 and 8. In an exemplary embodiment, the fold 140 extends vertically from the bottom member 110 and is generally located between the aperture 116 and the second portion 114 of the bottom member 110. The fold 140 helps prevent the finger 220 of the contact housing 200 from becoming damaged upon rearward movement (see arrow C in FIG. 8) of the electrical contact 100 (or rearward movement of the wire 300 connected thereto) while the electrical contact 100 is within the contact housing 200. More specifically, the fold 140 increases the surface area of the portion of the electrical contact 100 that contacts the finger 220 upon rearward movement of the electrical contact 100. The increased surface area decreases the force exerted on the finger 220, which decreases the likelihood of the finger 220 becoming sheared or otherwise damaged. More specifically, in an electrical contact 100 without a fold 140, the portion of the bottom member 110 which is adjacent the aperture 116 may break the finger 220 of the contact housing 200 when someone attempts to pull the electrical contact 100 out of the contact housing 200.

The stop member 150 is illustrated in FIGS. 2 and 8. It is envisioned for the stop member 150 to extend substantially vertically from the bottom member 110, such that the stop member 150 is substantially perpendicular to the plane A-A. It is also envisioned for the stop member 150 to extend from the bottom member 110 between the first portion 112 of the bottom member 110 and the aperture 116. Additionally, as shown in FIG. 8, the stop member 150 may include a horizontal extension 152 extending therefrom. The stop member 150 (and the optional horizontal extension 152) may help contain the wire 300 between the first portion 112 of the bottom member 110 and the aperture 116. Being contained in such a location prevents the wire .300 from entering certain areas of the electrical contact 100 (such as the opening 122) where it may interfere with other components (such as the post 400). The stop member 150 may also assist in the process of crimping the electrical contact 100 onto the wire 300 by helping to align multiple strands 302 (FIG. 8) of the wire 300. The process of aligning the strands 302 of the wire 300 might otherwise be difficult and time consuming because certain tolerances must be met for optimum performance. For example, in certain applications, the strands 302 of the wire 300 cannot extend past a wire insulation 304 (FIG. 8) more than 0.020 inches. Therefore, to accurately align the strands 302 of the wire 300, a user can insert the wire 300 into the electrical contact 100, continue to move the wire 300 so that its strands 302 contact the stop member 150. Once contact is made between the strands 302 and the stop member 150, the user knows that the strands 302 are all extending to the same point (i.e., to the stop member 150), thus the strands 302 are precisely aligned. Once the strands 302 are aligned, the wire 300 can be crimped.

Figure 4:
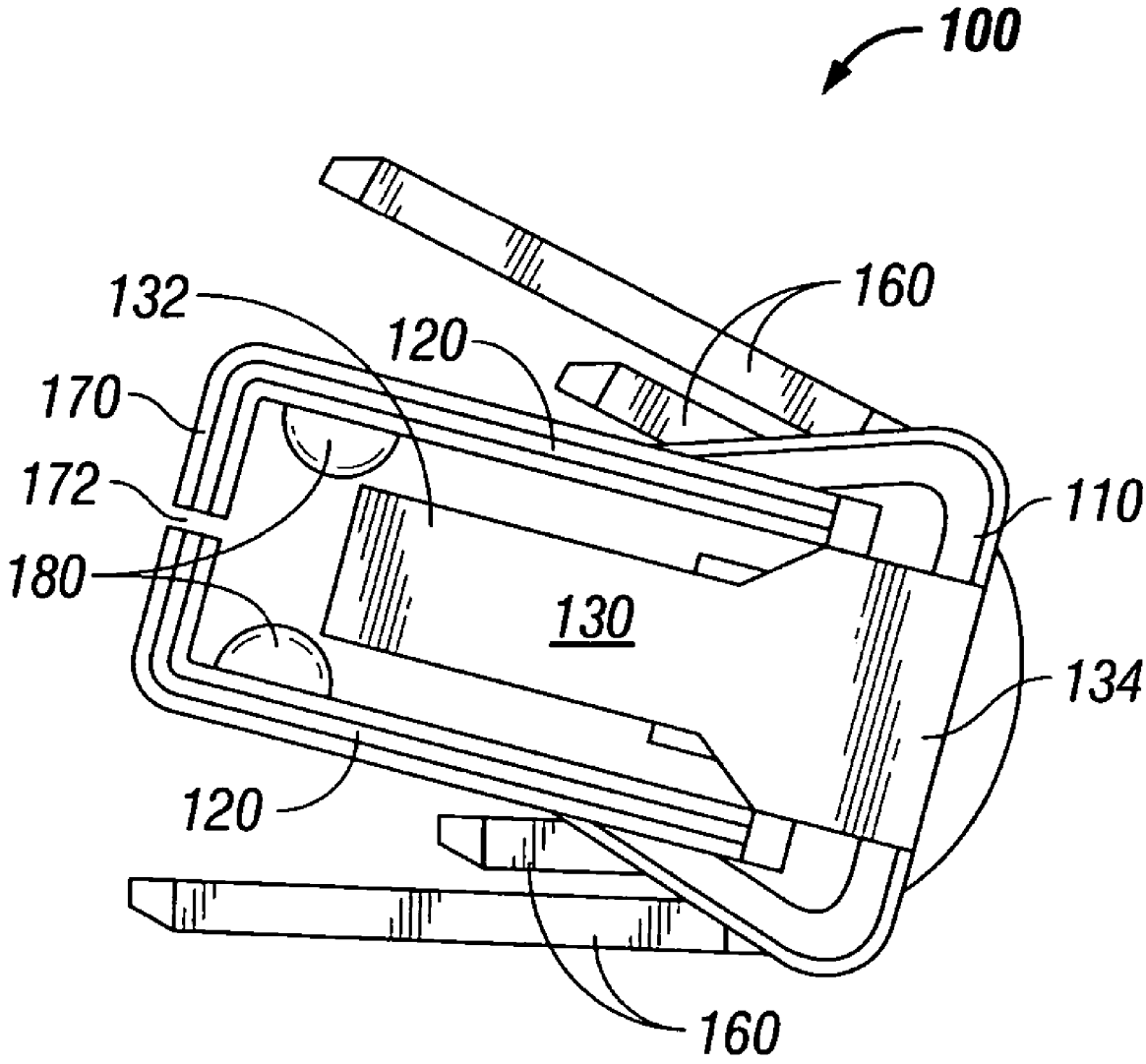
FIG. 4 is a plan view of an embodiment of the electrical contact of FIG. 1.

In an exemplary embodiment and with reference to FIGS. 1 and 3-5, a plurality of legs 160 extend from the bottom member 110. As best seen in FIGS. 1 and 4, two pair of legs 160 are illustrated. It is envisioned for each of the plurality of legs 160 to be deflectable and to be biased outwardly. The plurality of legs 160 helps secure the electrical contact 100 within the contact housing 200, as will be described in more detail below.

It is contemplated for the electrical contact 100 to include a top member 170, as shown in FIGS. 1, 2, 4, 5 and 8. The top member 170 may be substantially parallel to the bottom member 110 and is affixed to the side walls 120. The top member 170 helps secure the electrical contact 100 within the contact housing 200. More specifically, the top member 170 includes inner surface 170' which acts as a point of contact between the post 400 and the electrical contact 100. In other words, when the post 400 is inserted into the opening 122 of the electrical contact 100, the tongue 130 pushes the post 400 (in the direction of arrow in FIG. 8) against the inner surface 170' of the top member 170 and an electrical connection is established between the post 400 and both the tongue 130 and the inner surface 170' of the top member 170. It is envisioned for an opening 172 to extend through the top member 170, as seen in FIGS. 1 and 4, which enables greater deflection of the side walls 120.

In an exemplary embodiment, and as shown in FIGS. 1-5 and 8, a plurality of interface points 180 (illustrated as four interface points 180 in FIG. 1) are included on the electrical contact 100. More specifically, the interface points 180 may be included on an upper portion of each of the side walls 120 and may protrude inwardly, such that the interface points 180 on opposite side walls 120 face each other. When a post 400 is inserted into the opening 122 of the electrical contact 100, the post 400 contacts the interface points 180 and an electrical connection is established there between.

Figure 6:
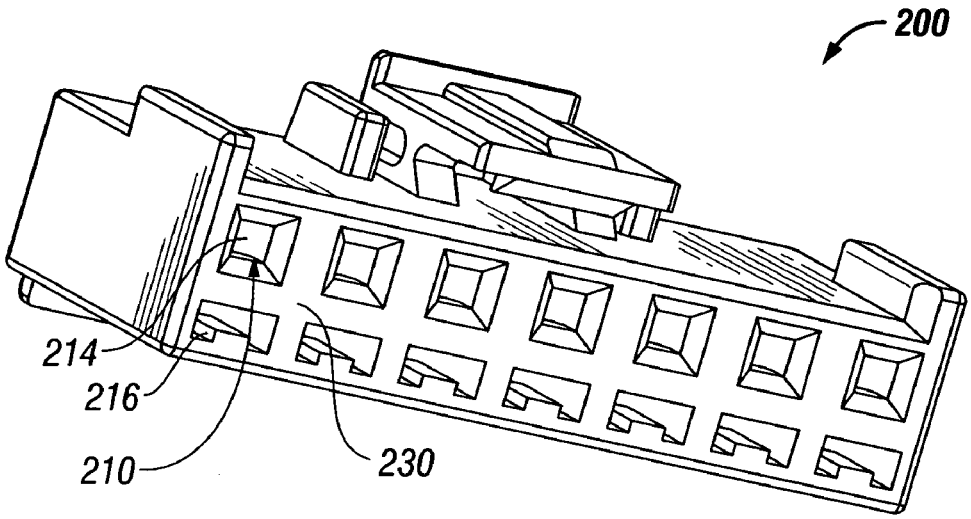
FIG. 6 is a front perspective view of an embodiment of the contact housing of FIG. 5.
Figure 7:
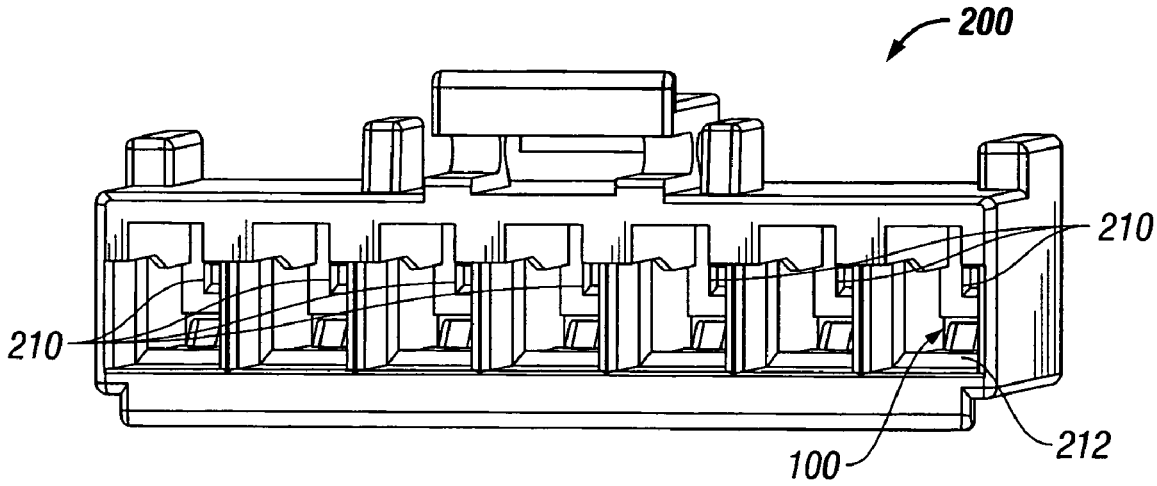
FIG. 7 is a rear perspective view of an embodiment of the contact housing of FIG. 5.

To facilitate the description of the connection between the electrical contact 100 and the contact housing 200, the features of the contact housing 200 will now be described with reference to FIGS. 5-8. The contact housing 200 includes a plurality of compartments 210, each for receiving an electrical contact 100. Only one compartment 210 will be described hereinafter, for clarity, but as can be appreciated, each of the compartments 210 may be similarly configured for receiving an electrical contact 100. The compartment 210 of the contact housing 200 includes a first cavity 212 (FIGS. 7 and 8), a housing cross bar 230 (FIGS. 5, 6 and 8), which separates an upper cavity 214 (FIGS. 6 and 8) and a lower cavity 216 (FIGS. 6 and 8). The contact housing 200 also includes a finger 220, as described above. The contact housing 200 is generally made from a non-conductive material.

The compartment 210 of the contact housing 200 is designed and configured to house at least a portion of the electrical contact 100. The first cavity 212 of the contact housing 200 is designed and configured to allow insertion of the electrical contact 100 into the compartment 210 of the contact housing 200. The upper cavity 214 is designed and configured to allow at least a portion of a post or conductor 400 of a connector (not shown) to pass there through and to enter the electrical contact 100. The lower cavity 216 facilitates the manufacturing of the contact housing 200. It is envisioned for the contact housing 200 not to include a lower cavity 216.

The insertion of the electrical contact 100 into the contact housing 200 will now be described. First, as described above, the wire 300 is crimped to the electrical contact 100 and the electrical contact 100 is inserted into a compartment 210 of the contact housing 200 through the first cavity 212 therein. As the electrical contact 100 contacts the finger 220 of the contact housing 200, the electrical contact 100 deflects and passes over the finger 220. (It is envisioned for the electrical contact 100 to include a lance (not shown). In such an embodiment, the finger 220 of the contact housing 200 and the lower opening 116 of the electrical contact 100 may not be necessary.) As shown in FIGS. 5 and 8, the finger 220 may be ramp-like to facilitate this procedure. The aperture 116 of the electrical contact 100 fits over/mates with the finger 220, which helps secure the electrical contact 100 within the contact housing 200, as described above.

The contact that the electrical contact 100 makes with inner walls 218 (FIGS. 5 and 8) of the compartment 210 also help secure the electrical contact 100 within the contact housing 200. As described above, other features of the electrical contact 100 which help secure the electrical contact 100 within the contact housing 200 include the side walls 120, the ribs 124, the plurality of legs 160 and the top member 170. As mentioned above, it is also envisioned for a lance (not shown) to help secure this arrangement. Additionally, the fold 140 helps keep the electrical contact 100 within the contact housing 200 when a rearward force (arrow C in FIG. 8) is exerted on the electrical contact 100 (or when a forward force (opposite direction of arrow C) is exerted on the contact housing 200). The fold 140 creates a blunt interface between the electrical contact 100 and the finger 220 of the contact housing 200 which minimizes the possibility of causing damage to the finger 220 upon an exertion of force. Thus, the fold 140 allows the finger 220 to withstand a greater back-out force, as described above. More specifically, without the fold 140, the exertion of rearward force on the electrical contact 100 (which may result from pulling the wire 300) may cause the finger 220 of the contact housing 200 to become sheared or otherwise damaged.

As illustrated in FIG. 8, when the electrical contact 100 is secured within the contact housing 200, the post 400 of a connector 402 can be inserted to make an electrical connection with the electrical contact 100. The post 400 is initially inserted through the upper cavity 214 of the contact housing 200. After the post 400 is inserted through the upper cavity 214, the post 400 contacts the tongue 130 of the electrical contact 100 and causes at least a portion of the tongue 130 to deflect (in the opposite direction of arrow B in FIG. 8). In an exemplary embodiment, the upper portion 132 of the tongue 130 deflects towards the bottom member 110.

As shown in FIG. 8, the bias of the tongue 130 exerts an upward force (illustrated by arrow B) on the post 400 against the inner surface 170' of the top member 170. This force helps maintain the tongue 130 within the electrical contact 100. The tongue 130, therefore, increases the normal forces on the post 400, which in turn decreases the contact resistance and increases the current capacity of the connector 402. As can be appreciated, the post 400 is insertable and removable from the electrical contact 100.

Due in part to various features of the present disclosure, the wire 300 and the electrical contact 100 may be securely maintained within the contact housing 200 and a portion of the post 400 may be securely inserted into the electrical contact 100. Such secure connections help ensure the electrical contact 100 does not become separated from the contact housing 200 and the post 400 does not become inadvertently dislodged from the electrical contact 100. The features help maintain such connections even when the contact housing 200, the wire 300 and/or the post 400 are subjected to high external forces or vibrations, such as when used with a washing machine.

It is to be understood that the foregoing description is merely a disclosure of particular embodiments and is in no way intended to limit the scope of the disclosure. Other possible modifications will be apparent to those skilled in the art and all modifications will be apparent to those in the art and all modifications are to be defined by the following claims.

What is claimed:

1. An electrical contact, comprising:

a bottom member defining a horizontal plane, the bottom member comprising a first portion and a second portion;

a pair of side walls extending away from the bottom member, the pair of side walls defining an opening therebetween disposed above the second portion of the bottom member;

a stop member extending from the bottom member and in the direction of the pair of side walls, the stop member being configured to limit distal movement of a wire positioned proximal thereto;

a tongue disposed at least partially between the side walls, the tongue having an upper portion and a lower portion, and extending at an angle with respect to the horizontal plane, wherein the upper portion of the tongue terminates at a location distal of the stop member; and a fold extending from the bottom member in the direction of the tongue, whereby a conductor is insertable into the electrical contact via the opening, such that at least a portion of the tongue helps maintain at least a portion of the conductor at least partially within the electrical contact.

2. The electrical contact according to claim 1, further comprising an aperture defined through the bottom member, the aperture being engagable with a finger of a contact housing.

3. The electrical contact according to claim 1, wherein the tongue is deflectable.

4. The electrical contact according to claim 1, wherein the lower portion of the tongue is affixed to the bottom member.

5. The electrical contact according to claim 1, wherein the angle between the tongue and the bottom member is between about 35° and about 55°.

6. The electrical contact according to claim 1, wherein the fold is disposed between an aperture in the bottom member and the second portion of the bottom member.

7. The electrical contact according to claim 1, wherein the stop member is disposed at a location proximal of the tongue.

8. The electrical contact according to claim 7, wherein the stop member further comprises a horizontal extension extending therefrom, the horizontal extension being substantially parallel with the bottom member.

9. The electrical contact according to claim 1, further comprising a stop member extending away from the bottom member.

10. The electrical contact according to claim 1, further comprising a plurality of legs extending away from the bottom member.

11. The electrical contact according to claim 10, wherein at least one of the plurality of legs is deflectable.

12. The electrical contact according to claim 1, wherein at least a portion of the tongue is biased towards the opening.

13. The electrical contact according to claim 1, further comprising a top member extending from each side wall and being substantially parallel to the bottom member, wherein an opening is formed between the top members for facilitating deflection of the side walls.

14. The electrical contact according to claim 1, further comprising a plurality of interface points extending inwardly from at least one side wall, the plurality of interface points help maintain at least a portion of the conductor at least partially within the electrical contact.

15. An electrical contact, comprising:

a bottom member defining a horizontal plane, the bottom member comprising an aperture defined therethrough, a first portion and a second portion;

at least one side wall extending substantially vertically from the bottom member;

a fold extending from the bottom member, in the direction of the tongue, and being disposed between the aperture and the second portion of the bottom member; and a stop member extending from the bottom member in the direction of the side walls, the stop member being configured to limit distal movement of a wire positioned proximal thereto, whereby the first portion of the bottom member is configured to receive a plurality of wires, the electrical contact is insertable into a contact housing such that the aperture of the bottom member of the electrical contact is configured to mate with at least a portion of a finger of the contact housing, and the electrical contact is configured to releasably receive at least a portion of a conductor in an opening therein.

16. The electrical contact according to claim 15, further comprising a tongue extending from the bottom member at an angle with respect to the horizontal plane.

17. The electrical contact according to claim 15, wherein the stop member is disposed at a location proximal of the tongue.

18. An electrical contact, comprising:

a bottom member defining a horizontal plane, the bottom member comprising a first portion and a second portion;

a pair of side walls extending substantially vertically from the bottom member;

a stop member extending away from the bottom member in the direction of the pair of side walls, the stop member being configured to limit distal movement of a wire positioned proximal thereto;

a tongue disposed between the pair of side walls and including an upper portion terminating at a location distal of the stop member; and a fold extending from the bottom member at a location beneath the tongue, whereby the first portion of the bottom member is configured to receive a plurality of wires, the electrical contact is insertable into a contact housing, and the electrical contact is configured to releasably receive at least a portion of a conductor in an opening therein.

19. The electrical contact according to claim 18, wherein the tongue extends at an angle from the bottom member, and wherein the tongue is deflectable and at least a portion of the tongue is biased towards the opening of the electrical contact.

* * * * *